US012330828B2

(12) United States Patent
Hauser

(10) Patent No.: US 12,330,828 B2
(45) Date of Patent: Jun. 17, 2025

(54) BAG HANGER WITH REMOTE ACTUATED DEVICE

(71) Applicant: The Young Industries, Inc., Muncy, PA (US)

(72) Inventor: Joseph A. Hauser, Williamsport, PA (US)

(73) Assignee: THE YOUNG INDUSTRIES, INC., Muncy, PA (US)

( * ) Notice: Subject to any disclaimer, the term of this patent is extended or adjusted under 35 U.S.C. 154(b) by 0 days.

(21) Appl. No.: 18/614,828

(22) Filed: Mar. 25, 2024

(65) Prior Publication Data

US 2024/0359849 A1 Oct. 31, 2024

Related U.S. Application Data

(60) Provisional application No. 63/498,987, filed on Apr. 28, 2023.

(51) Int. Cl.
*B65B 43/54* (2006.01)
*B65B 37/02* (2006.01)
*B65B 39/06* (2006.01)

(52) U.S. Cl.
CPC ..... *B65B 43/54* (2013.01); *B65B 37/02* (2013.01); *B65B 39/06* (2013.01)

(58) Field of Classification Search
CPC ..... B65B 43/54; B65B 43/42; B65B 37/02; B65B 39/06
See application file for complete search history.

(56) References Cited

U.S. PATENT DOCUMENTS 5,036,893 A * 8/1991 DeCrane ..... B65B 67/1227 141/10
5,056,571 A * 10/1991 Derby ..... B65B 69/0091 141/10
7,267,145 B2 * 9/2007 Nyhof ..... B65B 1/04 141/114
7,353,851 B2 4/2008 Sterner et al.

OTHER PUBLICATIONS

The Complete Bulk Bag Filler Customization Guide, Spiroflo, URL:<https://www.spiroflow.com/wp-content/uploads/2023/09/Spiroflow-Bulk-Bag-Filler-Guide-.pdf.>, retrieved from the Internet Mar. 22, 2024)(date unknown).
"Fill one bulk bag per week or 20 per hour at the lowest cost per bag", FF-0494A, flexicon.com, Flexicon Corporation, 2019.
Bulk Bag Fillers, National Bulk Equipment An NBE Company, www.nbe-inc.com, 21-NBK-0241 (date: on or before Mar. 14, 2024).

* cited by examiner

*Primary Examiner* — Jason K Niesz
(74) *Attorney, Agent, or Firm* — Vorys, Sater, Seymour and Pease LLP

(57) ABSTRACT

A bag hanger for bulk bag filler equipment. The bag hanger can include a plurality of support plates coupled together to form a body structure. Also, the bag hanger can include a hook that is integral with the body structure, wherein the hook at least partially defines a containment area and is configured to receive a bag strap. Further, the bag hanger can include an ejector plate, and an actuator. The ejector plate can be positioned between the plurality of support plates. The actuator can be coupled to the ejector plate and the body structure.

20 Claims, 7 Drawing Sheets

BAG HANGER WITH REMOTE ACTUATED DEVICE

FIELD OF THE DISCLOSURE

The present disclosure relates generally to bag hangers for bulk bag filler equipment and, more particularly, to a system of bag hangers configured to: receive a bag support strap for loading a bag during a filling operation, and eject the bag support strap using an actuator that can be controlled from a remote location.

BACKGROUND OF THE DISCLOSURE

In bulk material handling, it is common practice to transport and store voluminous amounts of material in large fabric containers, which are often referred to as "bulk bags" or "super sacks." These bulk bags are lifted and supported via multiple heavy duty support straps secured at various positions of the bulk bag. For example, bulk bags typically include four straps, with each strap positioned at a respective corner of the bulk bag's top side inlet.

During a filling operation, bulk bag filler equipment is utilized to load the bulk bag, support the bulk bag while being filled with material, and release the filled bulk bag. For example, the bulk bag can be hung from the bulk bag filler equipment by bag hangers that engage the plurality of support straps; thereby the bulk bag filler equipment is used to support the bulk bag to ensure an even filling of the material. Once the bulk bag is loaded, the material is supplied to the bulk bag via an opening in the top of the bulk bag. When fully filled with material, the weight of the filled bulk bag is predominantly supported by the bulk bag filler equipment (e.g., via the bag hangers). Subsequently, the weight of the filled bulk bag can be transferred to a pallet to relieve load from the bag hangers; whereupon the support straps can be released from the bag hangers, and the bulk bag can be moved from the bulk bag filler equipment for further transport. To facilitate bulk material handling operations at scale, one or more conveyor systems can be configured to move the bulk bags to and from the bulk bag filler equipment.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a bag hanger is provided. The bag hanger can comprise a plurality of support plates coupled together to form a body structure. Also, the bag hanger can comprise a hook that is integral with the body structure, where the hook at least partially defines a containment area and is configured to receive a bag strap. Further, the bag hanger can comprise an ejector plate positioned between the plurality of support plates and coupled to an actuator, where the actuator is coupled to the ejector plate and the body structure.

In another embodiment, a bulk bag filler equipment assembly is provided. The bulk bag filler equipment assembly can comprise a support frame comprising a support rail. The bulk bag filler equipment assembly can also comprise a bag hanger mounted to the support rail. The bag hanger comprises a hook that is integral with a body of the bag hanger and an ejector plate at least partially positioned within the body. Also, the ejector plate is configured to translate between a loading position and an ejecting position while the hook remains in a fixed position. Further, the bulk bag filler equipment assembly can comprise a fluid control system coupled to the bag hanger, wherein the fluid control system is configured to control operation of the ejector plate.

In a further embodiment, a method for filling a bulk bag is provided. The method can comprise loading a support strap of the bulk bag onto a hook of a bag hanger. The hook can be integral with a body of the bag hanger, and wherein the bag hanger comprises an ejector plate coupled to an actuator. The method can also comprise supplying a material to the bulk bag. Additionally, the method can comprise ejecting the support strap from the hook via a movement of the ejector plate that is driven by the actuator. The ejector plate can move from a loading position to an ejecting position while the hook remains in a fixed position.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1A:
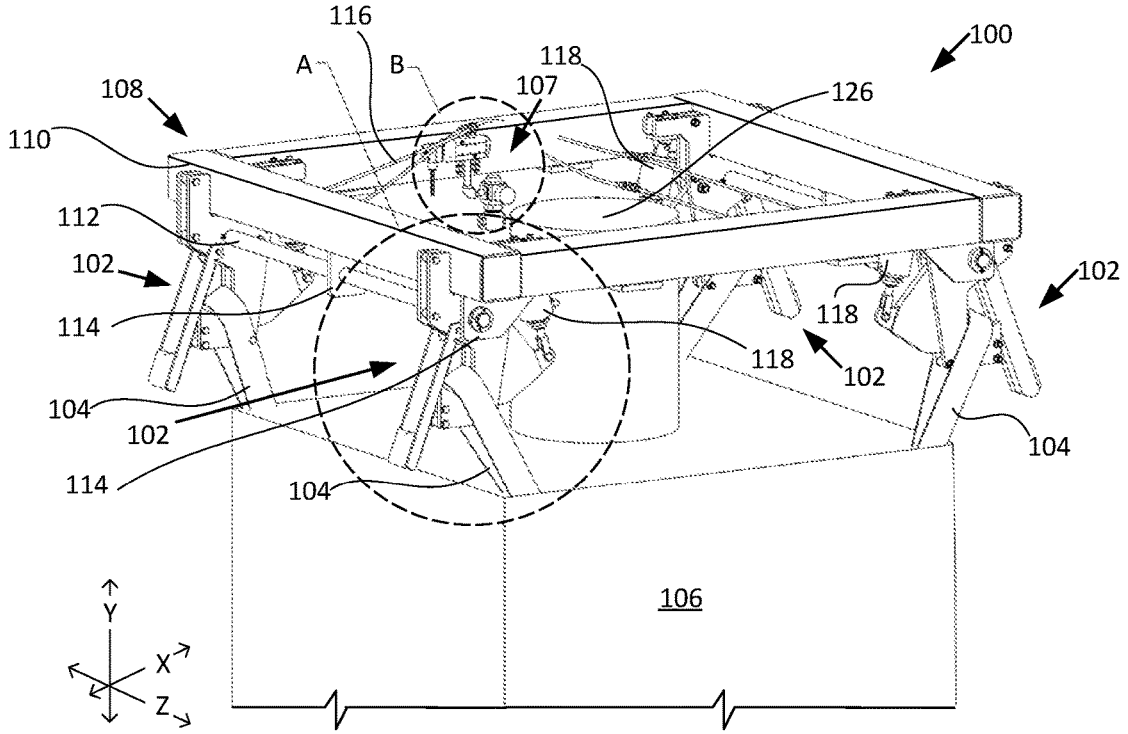
FIG. 1A illustrates a diagram of a non-limiting example bulk filler equipment assembly comprising one or more loaded bag hangers, where the bag hangers can include a remotely actuated device (e.g., an ejection plate) in accordance with one or more embodiments described herein.

Embodiments of the present disclosure will now be described in detail with reference to the accompanying figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Conventionally, bulk bag filler equipment utilizes a clamping mechanism in which bag hangers are manually operated into an open or closed state. For example, support straps are manually released from the bag hangers by an operator after the bulk bag is filled and before transportation beyond the filling station. Releasing the bulk bag from the bag hangers can be difficult and/or a safety concern because the operator often has limited access to the clamping mechanism (e.g., the operator may only have access to one side of the bulk bag filler equipment). For instance, the position and/or architecture of the bulk bag filler equipment, along with the presence of additions systems (e.g., conveyor systems) and/or obstructions, can limit accessibility to the bag hangers once the bulk bag is filled.

For example, when loading the empty bulk bag onto the bulk bag filler equipment, the operator will often step on a support structure (e.g., a pallet) to reach the clamping mechanism on the far side of the equipment; however, when the filled bulk bag is positioned over the support structure (e.g., at least partially residing on the pallet), the operator's access to the far side of the bulk bag filler equipment is inhibited. As such, manual operation of the bag hangers located on the far side of the bulk bag filler equipment can likewise be inhibited (e.g., especially regarding to attempts to release the support strap from the clamping mechanism).

Embodiments in accordance with the present disclosure generally relate to one or more actuator driven bag hangers for bulk filler equipment. In various embodiments, each bag hanger can comprise an integral hook configured to receive a support strap of a bulk bag. Access to the hook can be controlled by a clasp, which can translate between an open position and a closed position. While in the open position (e.g., engaged via manual operation of the clasp), the clasp can enable the support strap to access and engage the hook. While in the closed position, the clasp can inhibit migration of the support strap from a containment area defined by the hook. In one or more embodiments, the bag hanger can further comprise an ejector plate operably coupled to an actuator (e.g., a pneumatic or hydraulic cylinder), where the ejector plate can translate between a loading position and an ejecting position. While in the loading position, the ejector plate can remain absent from the hook's containment area (e.g., the clasp can be manually positioned to the open position while the ejector plate is in the loading position to facilitate loading of a bulk bag, where the retracted state of the ejector plate can allow one or more support straps to engage the hook). While in the ejecting position, the ejector plate can occupy the containment area.

As the ejector plate transitions from the loading position to the ejecting position, the ejector plate can displace materials occupied within the containment area. For example, where a support strap is positioned in the containment area, the ejector plate can displace the support strap out of the containment area (e.g., free of the hook). Thereby, the ejector plate can, at the control of the actuator, release a captured support strap from confinement on the hook. Further, in one or more embodiments, a positioning arm can extend between the clasp and the ejector plate; thereby, movement of the ejector plate can cause movement of the clasp. For example, as the ejector plate translates from the loading position to the ejecting position, the ejector plate can engage the positioning arm to impart a force onto the clasp; where the force can push the clasp to the open position, thereby providing an exit route for the support strap.

Advantageously, the integral nature of the hook with a body of the bag hanger can prevent inadvertent release of a loaded bulk bag (e.g., inadvertent release of a captured support strap). Further, the one or more bag hangers can include an adjustable mounting structure, such that the position and/or alignment of the one or more bag hangers can be modified and/or rearranged in relation to a support frame of the bulk bag filler equipment. The adjustability of a bag hanger's location can facilitate access to the one or more bag hangers while loading a bulk bag onto the bulk bag filler equipment. Moreover, the bag hangers can be operated via a separate control module; thereby enabling remote ejection of loaded support straps post fill operation. Remote ejection of the support straps can overcome access constraints and/or improve speed and efficiency of operations. For example, remote operation of the bag hanger's ejector plates can enable automatic release protocols for bulk bags that have been loaded with material, which can be executed in conjunction with high-throughput systems (e.g., powered roller conveyor systems) to expedite bag unloading and transportation procedures. In various embodiments, the force exerted by one or more actuators driving the ejector plate can be controlled (e.g., limited) to prevent inadvertent unloading of a support strap from the bag hanger. For example, the force exerted by the one or more actuators can be controlled via regulator pressure and/or the use of a pressure relief valve.

Figure 1B:
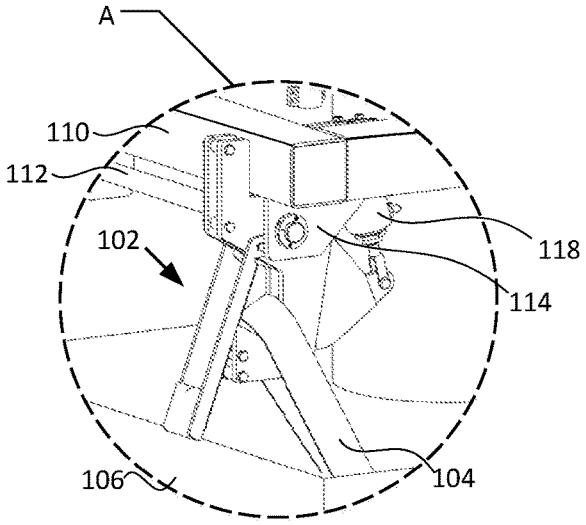
FIG. 1B illustrates a diagram of a magnified view of a bag hanger from FIG. 1A in accordance with one or more embodiments described herein.
Figure 1C:
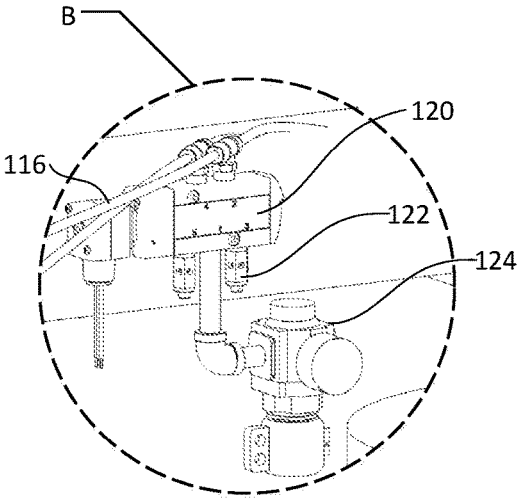
FIG. 1C illustrates a diagram of a magnified view of a fluid control system from FIG. 1A that can be used to control the one or more bag hangers in accordance with one or more embodiments described herein.

FIG. 1A illustrates anon-limiting example equipment assembly 100 comprising one or more bag hangers 102 in accordance with one or more embodiments described herein. FIG. 1B depicts a magnified view of detail A of the equipment assembly 100 (e.g., delineated by dashed lines in FIG. 1A). FIG. 1C depicts a magnified view of detail B of the equipment assembly 100 (e.g., delineated by dashed lines in FIG. 1A). In accordance with various embodiments described herein, the equipment assembly 100 can be integrated with, and/or a part of, a bulk bag filler equipment architecture. FIGS. 1A-1C depict the one or more bag hangers 102 in a loaded state, where one or more support straps 104 of a bulk bag 106 are loaded onto the bag hangers 102. While in the loaded state, the one or more bag hangers 102 can support a weight of the bulk bag 106 during one or more filling operations, where the bulk bag 106 can be filled with material.

FIG. 1A depicts an example equipment assembly 100 comprising four bag hangers 102, and FIG. 1B depicts a magnified view of one of the example bag hangers 102. While four bag hangers 102 are depicted in FIG. 1A, the architecture of the equipment assembly 100 is not so limited. For example, embodiments comprising fewer or more bag hangers 102 are also envisaged. In various embodiments, the bag hangers 102 can be operated via a fluid control system 107, as at least partially depicted in the magnified view of FIG. 1C.

As shown in FIGS. 1A-1B, the bag hangers 102 can be mounted to a support frame 108. In various embodiments, the support frame 108 can comprise one or more support rails 110 and/or support rods 112, which can have a polygonal geometry or a circular geometry. For example, FIG. 1A depicts an example embodiment in which the support frame 108 comprises polygonal (e.g., rectangular) support rails 110 (e.g., four support rails 110 arranged in a rectangular configuration) and cylindrical support rods 112 (e.g., two cylindrical support rods 112 positioned below, and fixed to, two of the support rails 110). In one or more embodiments, the support frame 108 can comprise one or more mounting plates 114 extending from one or more of the support rails 110. Further, a support rod 112 can extend through the one or more mounting plates 114 and through one or more bag hangers 102 to facilitate mounting the bag hangers 102 to the support frame 108 (e.g., as shown in FIGS. 1A and 1B). The bag hangers 102 can be mounted to various positions along the support rails 110 and/or support rods 112. For example, the position of the bag hangers 102 along the support rails 110 and/or support rods 112 can be adjusted based on the location of support straps 104 to the bulk bag 106 being filled by a given filling operation. For instance, one or more of the bag hangers 102 can be slid horizontally on the support rod 112 along the "Z" axis shown in FIG. 1A. In one or more embodiments, the one or more bag hangers 102 can be remotely slid along the support rod 112 to render the bag hangers 102 more accessible to users during a loading and/or unloading operation.

Each of the bag hangers 102 can be coupled to a fluid control system 107 via a plurality of tubes 116 extending between a respective actuators 118 of the bag hangers 102 and one or more valves 120 (e.g., a solenoid valve) of the fluid control system 107. In one or more embodiments, the actuators 118 can be linear actuators, such as pneumatic or hydraulic cylinders. FIGS. 1A and 1C depict breaks in the plurality of tubes 116 for illustrative purposes, where the plurality of tubes 116 can pursue a variety of trajectories and/or lengths within the breaks. The plurality of tubes 116 provide a continuous fluid communication between the actuators 118 and the one or more valves 120. In the example embodiment depicted in FIG. 1A, the four actuators 118 can be coupled to a four-way valve 120. Further, the one or more valves 120 can include one or more speed control mufflers 122 to control an operational speed of the actuators 118. Additionally, the one or more valves 120 can be coupled to one or more pressure regulators 124. In one or more embodiments, the one or more pressure regulators 124 can include a fluid (e.g., a pneumatic or hydraulic fluid) inlet operably coupled to a fluid supply (not shown). Additionally, the fluid control system 107 can be operably coupled to one or more control modules (not shown) (e.g., via a direct electrical connection or wireless connection) to facilitate control of the actuators 118 from a location remote (e.g., distanced) from the support frame 108.

In various embodiments, the one or more actuators 118 can be electric actuators, and the fluid control system 107 can be replaced with an electric control system (not shown). For example, the one or more actuators 118 can include one or more electric motors and/or integrated circuits (e.g., where an integrated circuit can facilitate control of an electric motor to drive a rod between an extended position and a retracted position). For instance, the one or more actuators 118 can be operably coupled (e.g., via one or more direct electrical connections, such as wires, or wireless connections) to one or more control modules to execute the various features described herein.

As shown in FIG. 1A, the support frame 108 and/or the plurality of tubes 116 can be positioned around a material inlet 126. For example, the material inlet 126 can be in fluid communication with an interior volume of the bulk bag 106 and one or more material suppliers (not shown). During a filling operation, material can be supplied to the bulk bag 106 via the material inlet 126, where the bulk bag 106 can hang from the bag hangers 102 via the support straps 104.

Figure 2A:
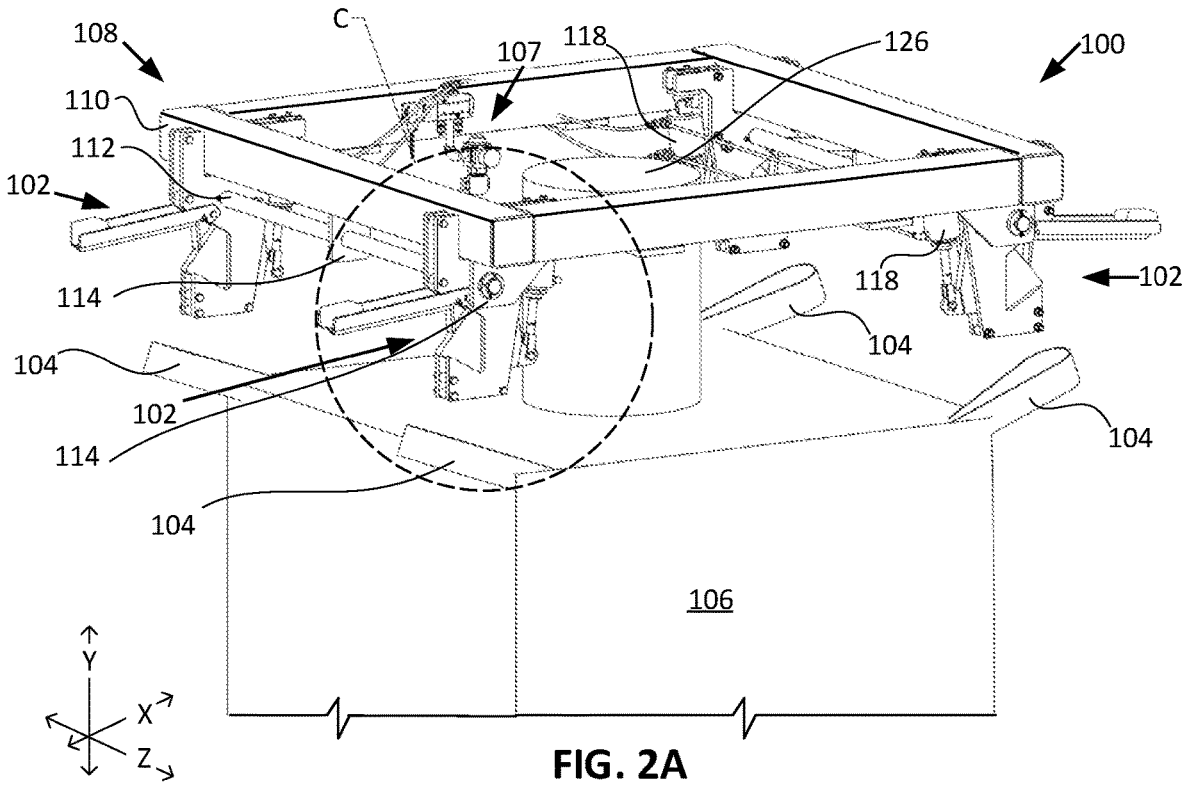
FIG. 2A illustrates a diagram of a non-limiting example bulk filler equipment assembly comprising one or more unloaded bag hangers, where the bag hangers can include a remotely actuated device (e.g., an ejection plate) in accordance with one or more embodiments described herein.
Figure 2B:
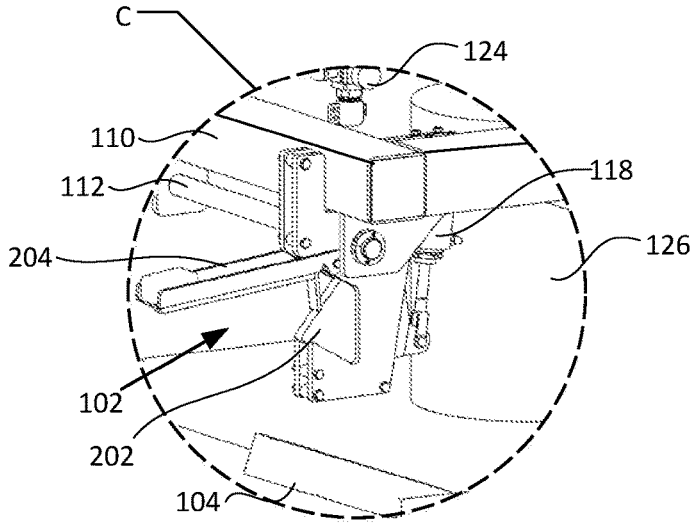
FIG. 2B illustrates a diagram of a magnified view of a bag hanger from FIG. 2A in accordance with one or more embodiments described herein.

FIG. 2A illustrates the non-limiting example equipment assembly 100 with the bag hangers 102 in an unloaded state. FIG. 2B depicts a magnified view of detail C of the equipment assembly 100 (e.g., delineated by dashed lines in FIG. 2A). While in the unloaded state, the support straps 104 are ejected from the bag hangers 102 as a result of operating the actuator 118 (e.g., pneumatic or hydraulic cylinder) to an extended state. In accordance with various embodiments described herein, controlling (e.g., via the fluid control system 107) the actuator 118 into the extended state can drive an ejector plate 202 of the bag hangers 102 into an ejecting position (e.g., as depicted in FIGS. 2A-2B) and a clasp 204 of the bag hangers 102 into an open position; thereby, forcing the support straps 104 to be displaced from the bag hangers 102.

Figure 3:
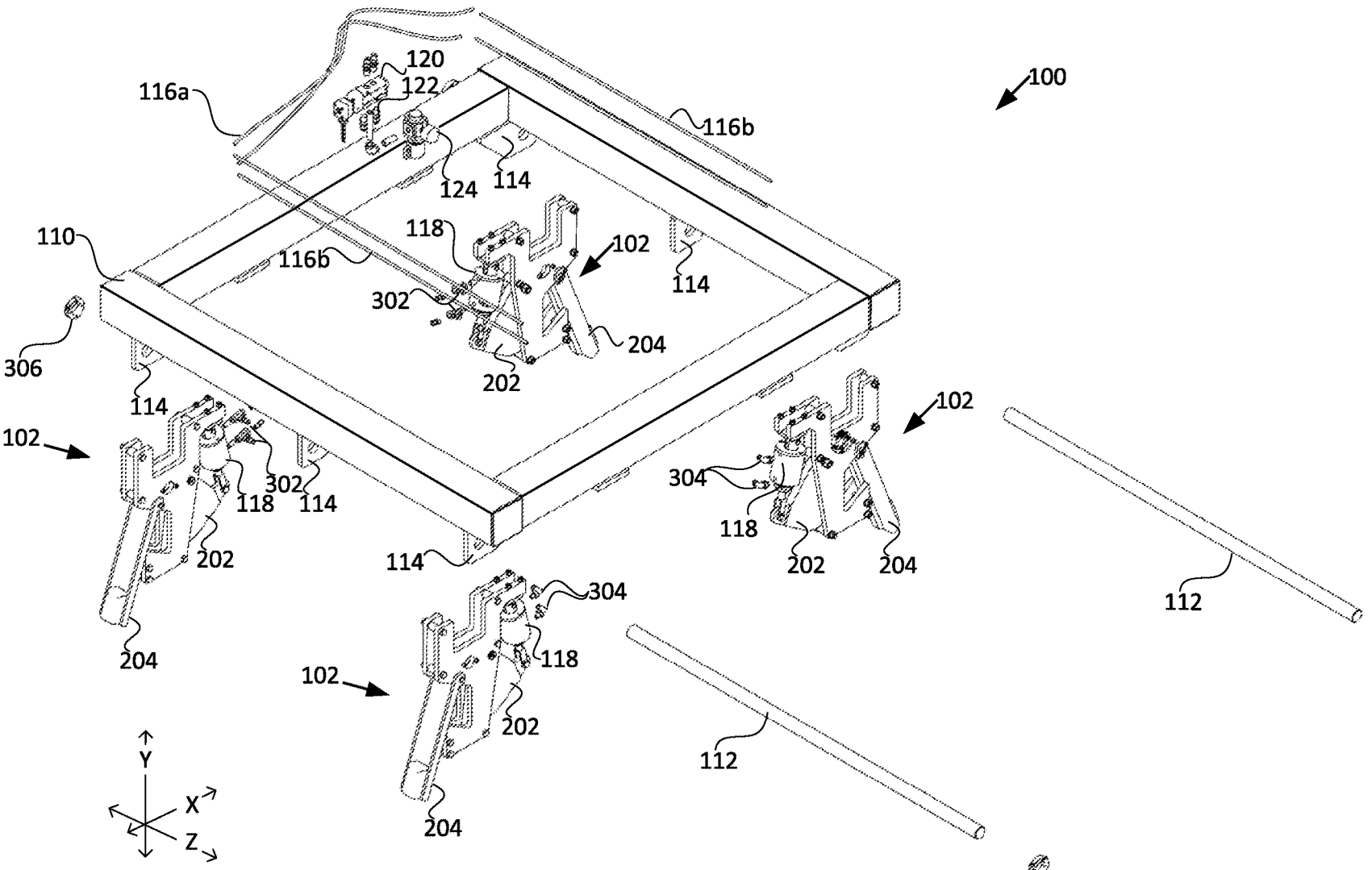
FIG. 3 illustrates a diagram of a non-limiting example exploded perspective of a bulk filler equipment assembly comprising one or more bag hangers, where the bag hangers can include a remotely actuated device (e.g., an ejection plate) in accordance with one or more embodiments described herein.

FIG. 3 depicts a non-limiting exploded view of the equipment assembly 100 in accordance with one or more embodiments described herein. For example, FIG. 3 depicts the various components of the equipment assembly 100 disassembled and spaced apart. While the various components are disassembled from each other, the components are depicted with an alignment that would facilitate assembly.

As shown in FIG. 3, the plurality of tubes 116 can be coupled to the actuators 118 via one or more tee fittings 302 and/or elbow fittings 304 fixed to fluid flow ports that facilitate extension or retraction of piston rods of the actuators 118 (e.g., piston rods of hydraulic cylinders). In the example embodiment depicted in FIG. 3, a first section of tubing 116*a* can extend from the valve 120 to the tee fittings 302 of a first set of bag hangers 102, and one or more second sections of tubing 116*b* can extend from the tee fittings 302 to the elbow fittings of a second set of bag hangers 102. Also shown in FIG. 3, one or more locking collars 306 can be utilized to secure the one or more support rods 112 in position in the mounting plates 114.

Figure 4A:
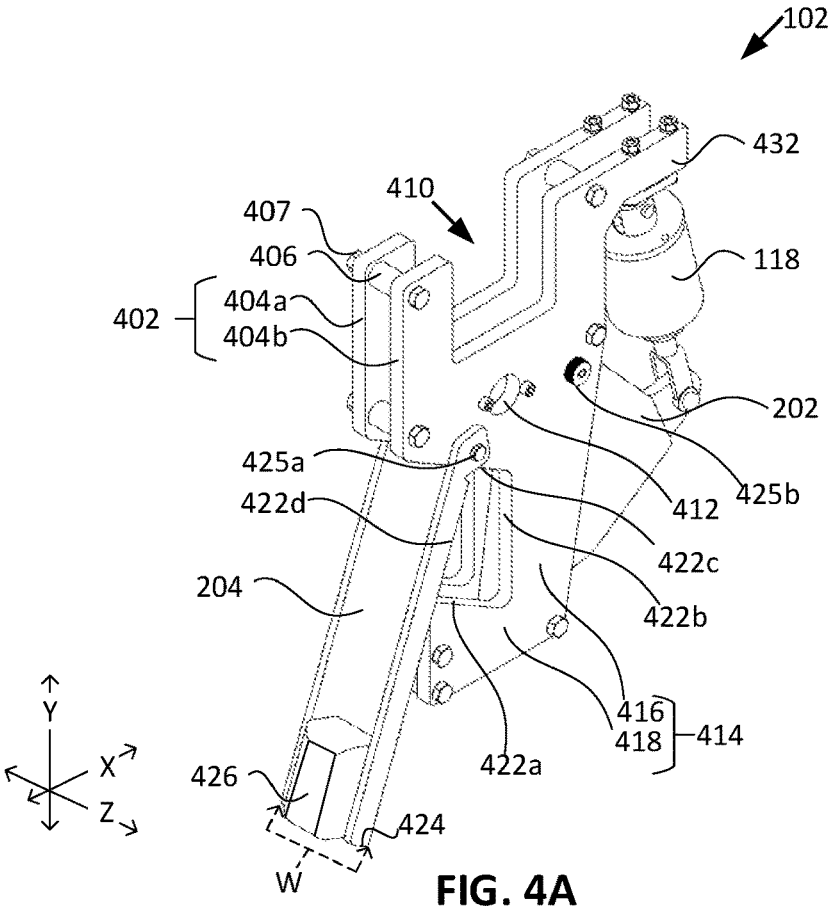
FIGS. 4A-B and 5A illustrate diagrams of a non-limiting example bag hanger having a clasp in a closed position and an ejector plate in a loading position, where operation of the clasp and/or ejector plate can be remotely controlled via an actuator in accordance with one or more embodiments described herein.
Figure 4B:
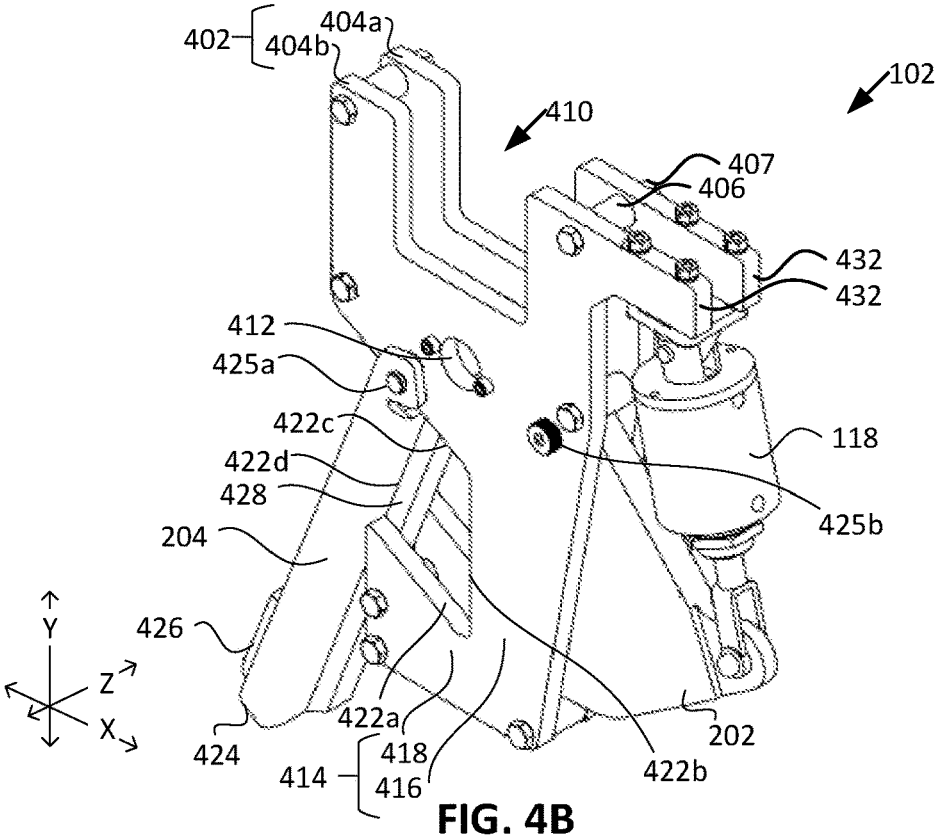

FIGS. 4A and 4B illustrate non-limiting example bag hangers 102 that can be utilized in the equipment assembly 100 in accordance with one or more embodiments described herein. FIG. 4A depicts a front-facing perspective of the bag hanger 102, and FIG. 4B depicts a rear-facing perspective of the bag hanger 102. As shown in FIGS. 4A and 4B, the bag hanger 102 can comprise a body 402 composed of multiple support plates 404 coupled together. For example, the body 402 of the bag hanger 102 can be composed of a first support plate 404*a* spaced (e.g., via one or more interposed spacers 406) a distance from a second support plate 404*b*. Further, the first support plate 404*a* and the second support plate 404*b* can be coupled together via one or more fasteners 407, such as nuts and bolts (e.g., which can extend through the one or more spacers 406). In various embodiments described herein, the support plates 404 can be composed of a rigid material, including, but not limited to: steel, aluminum, engineered plastics (e.g., high strength plastics), a combination thereof, and/or the like. In one or more embodiments, the support plates 404 can be cut from sheets of metal using one or more machining techniques (e.g., computer numerical control "CNC" machining, such as CNC water jet cutting and/or laser cutting).

In one or more embodiments, each of the support plates 404 can have a top portion that includes a mounting channel 410 that can facilitate engagement with a support frame 108. For example, the mounting channel 410 can be defined by aligned grooves in the top portion of each support plate 404. For instance, the grooves can have a U-shape, where the top of the groove can be open to receive a support rail 110 (e.g., as shown in FIGS. 4A-4B). In various embodiments, the geometry of the mounting channel 410 can complement the geometry of the one or more support rails 110. For instance, the rectangular geometry of the example mounting channel 410 shown in FIGS. 4A-4B can be complementary to the rectangular geometry of the support rail 110 to which the bag hanger 102 can be at least partially mounted. Thus, while FIGS. 4A-4B depict the mounting channel 410 having a rectangular geometry, alternate geometries (e.g., alternate polygonal geometries, or a circular geometry) are also envisaged. In one or more embodiments, the mounting channel 410 can provide stability to the bag hanger 102 while the bag hanger is mounted on a support rod 112. For example, sidewalls of the mounting channel 410 can abut sidewalls of the support rail 110 and prevent the bag hanger 102 from rotating about the support rod 112 (e.g., as shown in FIGS. 1A-B and 2A-2B).

In various embodiments, the support plates 404 can further comprise a mounting passageway 412 that travels through a lateral direction (e.g., represented by the "Z" axis in FIGS. 4A-4B) of the bag hanger 102. For example, the mounting passageway 412 can be defined by aligned holes in each of the support plates 404. Further, the mounting passageway 412 can be positioned in a central portion of the support plates 404 (e.g., as shown in FIGS. 4A-4B). In accordance with one or more embodiments, the mounting passageway 412 can be configured to receive one or more support rods 112, of the support frame 108. In one or more embodiments, the bag hangers 102 can lack the mounting passageway 412 and can include a top plate (not shown) that fixes to the top portion of the support plates 404 once the mounting channel 410 receives the support rail 110 (e.g., in a mounted position, the top plate can extend over the support rail 110 such that a perimeter of the support rail 110 is surrounded by the bag hanger 102).

Additionally, the support plates 404 can have a bottom portion that includes a hook 414. As shown in FIGS. 4A-4B, the hook 414 can be integral with the support plates 404, and thereby integral with the body 402 of the bag hanger 102. For each support plate 404, the hook 414 can include a stem portion 416 extending along a longitudinal direction (e.g., represented by the "Y" axis in FIGS. 4A-4B) of the bag hanger 102, and a protruding portion 418 extending at an angle from stem portion 416. In one or more embodiments, the stem portion 416 can extend in a direction away from the mounting channel 410 to a bottom end of the bag hanger 102 (e.g., as shown in FIGS. 4A-4B). Further, the protruding portion 418 can extend towards the clasp 204 (e.g., as shown in FIGS. 4A-4B). For example, the hook 414 and the mounting channel 410 can be positioned at opposite ends of the body 402 along the longitudinal direction of the bag hanger 102.

In one or more embodiments, the hook 414 can at least partially define a containment area 422 configured to receive and hold a support strap 104 of the bulk bag 106. For example: a bottom side of the containment area 422 can be defined by a sidewall 422*a* (e.g., a sidewall sloped towards the stem portion 416) of the protruding portion 418; a first side of the containment area 422 can be defined by a sidewall 422*b* of the stem portion 416; a top side of the containment area 422 can be defined by a sidewall 422*c* of the body 402 of the bag hanger 102; and a second side of the containment area 422 can be defined by an inner sidewall 422*d* of the clasp 204.

In various embodiments, the clasp 204 can be composed of metal. Also, the clasp 204 can extend from the support plates 404 to a distal end 424. The clasp 204 can be configured to translate between an open position and a closed position. For example, the clasp 204 can be fixed to the supporting plates 404 at a first pivot point 425*a* (e.g., comprising a rod extending through the clasp 204 and the support plates 404 along the lateral direction of the bag hanger 102) about which the clasp 204 can rotate between the open and closed positions. FIGS. 4A-4B depict the clasp 204 in the closed position. While in the closed position, at least a portion of the inner sidewall 422*d* of the clasp 204 defines the second side of the containment area 422, and/or can restrict access to, and from, the containment area 422. While in the open position, the clasp 204 can be positioned a distance away from the hook 414, thereby leaving the second side of the containment area 422 open (e.g., to accept a support strap 104, or to eject a support strap 104).

As shown in FIGS. 4A-4B, a weight 426 can be positioned at the distal end 424 of the clasp 204 to bias the clasp 204 to the closed position when the bag hanger 102 is vertically mounted along its longitudinal direction via the mounting channel 410 and/or mounting passageway 412 (e.g., where the weight 426 provides a gravity bias to position the clasp 204 in the closed position). In one or more embodiments, the bag hanger 102 can further comprise a spring (not shown) positioned between the clasp 204 and support plates 404 to provide a spring bias towards the closed position.

As shown in FIG. 4A, the clasp 204 can have a width "W" along the lateral direction (e.g., along the "Z" axis in FIG. 4A) that is greater than a width of the hook 414 along the lateral direction; thereby ensuring that the inner sidewall 422*d* of the clasp 204 completely covers the second side of the containment area 422 while the clasp 204 is in the closed position. As shown in FIG. 4B, the clasp 204 can further comprise a ridge 428 protruding from the inner sidewall 422*d*. While in the closed position, the ridge 428 can be positioned partially within the hook 414 and between the support plates 404 (e.g., positioned within the gap between the support plates 404 defined by the spacers 406). In accordance with various embodiments described herein, the ridge 428 can serve to push a support strap 104 further into the containment area 422 as the clasp 204 translates to the closed position. The ridge 428 can travel the entire length of the clasp 204 (e.g., as shown in FIG. 4B), or a portion of the length of the clasp 204.

As described herein, the bag hanger 102 can also include one or more actuators 118 (e.g., pneumatic, hydraulic, or electric cylinders). For example, an actuators 118 can be coupled to a first side of the support plates 404 that is opposite a second side of the support plates 404, where the hook 414 and/or clasp 204 are located. For instance, each of the support plates 404 can comprise a rear protrusion 432, to which a first end of the actuators 118 can be fixed. Additionally, a second end of the actuators 118 can be fixed to the ejector plate 202. Thus, the actuators 118 can be positioned between rear protrusions 432 of the support plates 404 and the ejector plate 202 at a rearward face of the bag hanger 102. In various embodiments, the actuator 118 can be coupled to the body 402 of the bag hanger 102 at an angle (e.g., as shown in FIGS. 4A-4B). For instance, the actuator 118 can be coupled to the body 402 of the bag hanger 102 such that the actuator 118 extends from the rear protrusion 432 at an angle away from the support plates 404 to an end of the ejector plate 202. The angle at which the actuator 118 is mounted with respect to the body 402 of the bag hanger 102 can vary depending on, for example: the dimensions of the support plates 402, the dimensions of the actuator 118, the type of actuator 118 utilized, and/or the dimensions of the ejector plate 202.

The ejector plate 202 can be coupled to, and positioned between, the support plates 404 (e.g., as shown in FIGS. 4A-4B). In one or more embodiments, the ejector plate 202 can be fixed to the support plates 404 at a second pivot point 425*b* (e.g., comprising a rod extending through the ejector plate 202 and the support plates 404 along a lateral direction of the bag hanger 102) about which the ejector plate 202 can rotate. For example, the ejector plate 202 can be rotatably coupled to the support plates 404 and positioned at least partially within the body 402 of the bag hanger 102. In accordance with various embodiments described herein, the ejector plate 202 can translate between a loading position and an ejecting position. FIGS. 4A-4B depict the ejector plate 202 in the loading position. While in the loading position, the ejector plate 202 can be absent from the containment area 422. While in the ejecting position, at least a portion of the ejector plate 202 can be located within the containment area 422. For example, the ejector plate 202 can be positioned within, and can translate through, the stem portion 416 of the hook 414.

For instance, the actuator 118 can be operated between a retracted or extended state. While the actuator 118 is in the retracted state, the ejector plate 202 can be pulled away from the protruding portion 418 of the hook 414. As the actuator 118 extends, the ejector plate 202 can be pushed towards the protruding portion 418 of the hook 414. Further, the speed of operation of the actuator 118, and thereby the speed of movement of the ejector plate 202, can be regulated via the fluid control system 107 (e.g., speed control mufflers 122). In another instance, the speed of operation of the actuator 118, and thereby the speed of movement of the ejector plate 202, can be regulated via an electronic control system (e.g., via one or more electronic methods, such as configuration settings programmable via one or more integrated circuits of an electronic actuator).

Figure 5A:
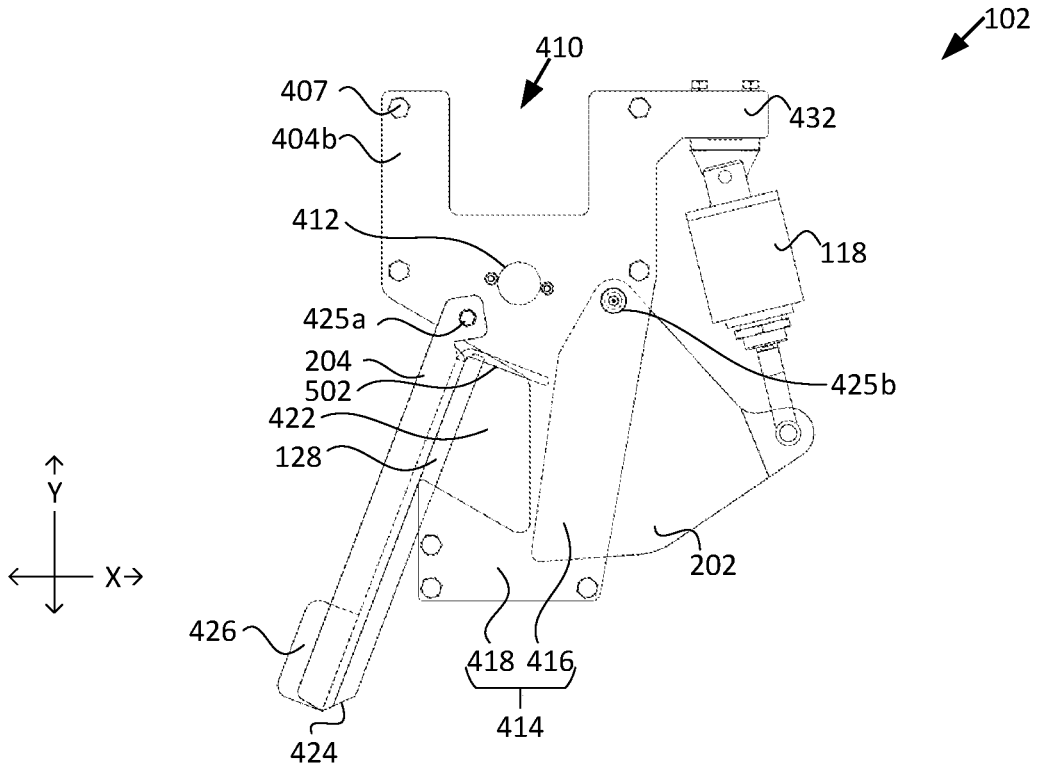
Figure 5B:
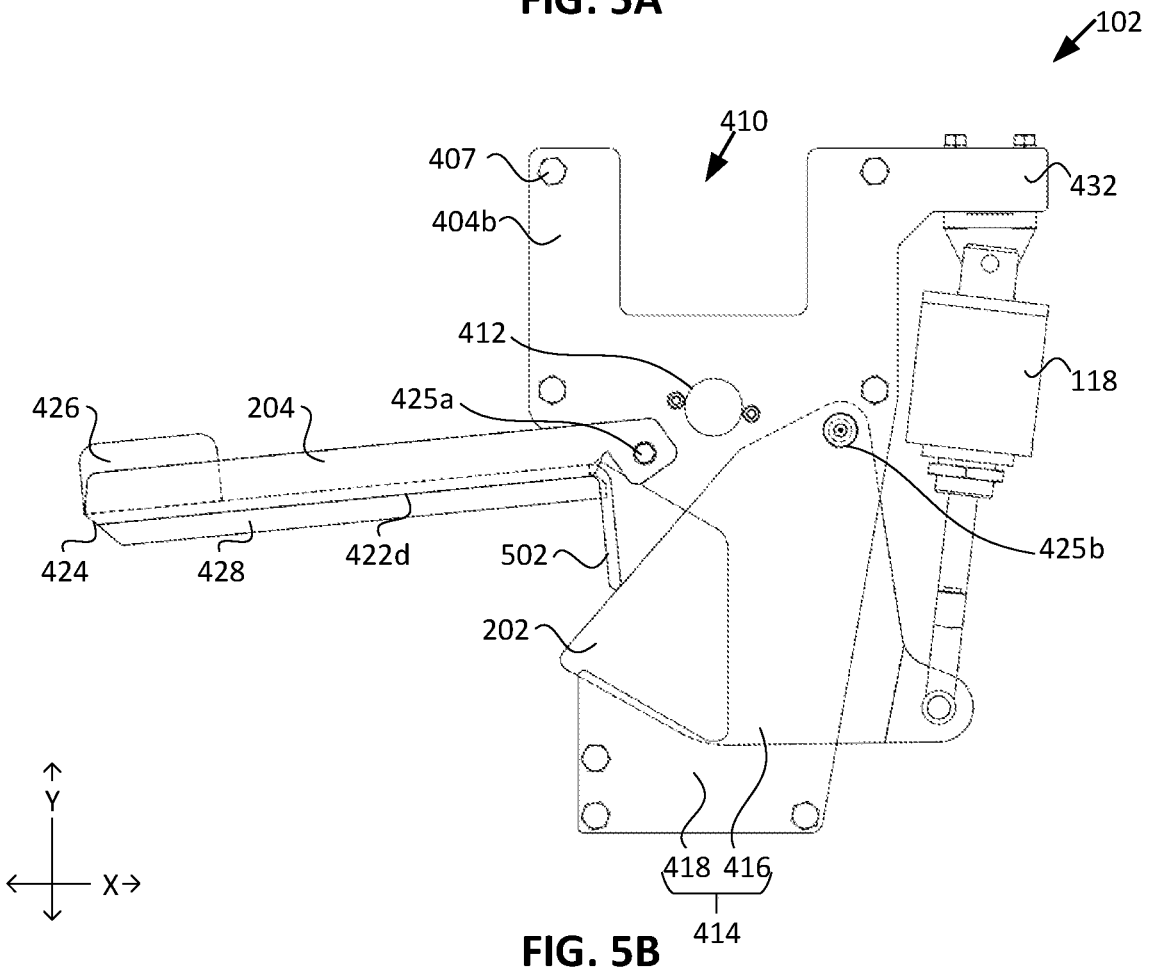
FIG. 5B illustrates a diagram of a non-limiting example bag hanger having a clasp in an open position and an ejector plate in an ejecting position, where operation of the clasp and/or ejector plate can be remotely controlled via an actuator in accordance with one or more embodiments described herein.

FIGS. 5A and 5B illustrate non-limiting side perspectives of the example bag hangers 102 in accordance with one or more embodiments described herein. FIG. 5A depicts a side perspective of the bag hanger 102 while the clasp 204 is in a closed position, and FIG. 5B depicts the side perspective of the bag hanger 102 while the clasp 204 is in the open position. As depicted in FIGS. 5A-5B, portions of features located behind other features, and thus otherwise inaccessible for viewing, are illustrated with dotted lines.

In various embodiments, the clasp 204 can further include one or more positioning arms 502 configured to set the position of the clasp 204 as a function of the position of the ejector plate 202. As shown in FIGS. 5A-5B, the clasp 204 can have a positioning arm 502 that extends at an angle (e.g., extends perpendicular) to the inner sidewall 422*d* of the clasp 204. For example, the positioning arm 502 can extend past the ridge 428. In one or more embodiments, the positioning arm 502 can extend from the clasp 204 toward a surface of the ejector plate 202. FIG. 2A utilizes dotted lines to illustrate the positioning arm's 502 extension within the clasp 204 and/or the body 402 of the bag hanger 102. For example, the positioning arm 502 can extend between the support plates 404 and/or at least partially into the stem portion 416 of the hook 414. In one or more embodiments, the positioning arm 502 can extend into a top portion of the containment area 422. Further, FIG. 5A utilizes dotted lines to illustrate the ejector plate's 202 extension into the body 402 of the bag hanger 102. For example, the ejector plate 202 can extend between the support plates 404 and/or at least partially into the stem portion 416 of the hook 414.

A comparison of FIGS. 5A and 5B exemplifies how the ejector plate 202 can engage the positioning arm 502 to transition the clasp 204 to the open position. In FIG. 5A the ejector plate 202 is in the loading position, and in FIG. 5B the ejector plate 202 is in the ejecting position. As the ejector plate 202 moves from the loading position to the ejecting position, a surface of the ejector plate 202 can abut the positioning arm 502. As the ejector plate 202 continues to move into the ejecting position, the ejector plate 202 can apply a force to the positioning arm 502, thereby pushing the clasp 204 to rotate about the first pivot point 425*a* to the open position.

Additionally, as the ejector plate 202 moves into the ejecting position, the ejector plate 202 comes to occupy the containment area 422; thereby the ejector plate 202 can displace any materials (e.g., support straps 104) positioned within the containment area 422 while the ejector plate 202 was in the loading position. For example, the surface of the ejector plate 202 that faces the containment area 422 can be sloped away from the stem portion 416 so as to enable a support strap 104 to slide down the ejector plate 202 and away from the bag hanger 102 when the ejector plate 202 is in the ejecting position. Moreover, the clasp 204 can be held in the open position via the positioning arm 502 abutting the ejector plate 202; thereby ejection of the support strap 104 from the containment area 422 can be uninhibited by the clasp 204 while the ejector plate 202 is in the ejecting position. While the ejector plate 202 and/or the clasp 204 move between positions, the hook 414 can remain fixed in place due to the hook's 414 integral nature with the body 402 of the bag hanger 102. In accordance with the various features described herein, the shape of the ejector plate 202 can vary based on, for example, the dimensions of the hook 414 and/or containment area 422. For instance, the angle exhibited by the sloped surface of the ejector plate 202 can be greater than, or less than, the angle depicted in FIGS. 5A-5B.

In accordance with various embodiments described herein, movement of the ejector plate 202 can be controlled by the actuator 118. For example, FIG. 5A depicts the actuator 118 in a retracted state, thereby positioning the ejector plate 202 into the loading position. FIG. 5B depicts the actuator 118 in an extended state, thereby positioning the ejector plate 202 into the ejecting position.

Further, the clasp 204 can be manually moved to the open position, where the ejector plate 202 remains in the loading position. Manually moving the clasp 204 to the open position can enable access to the containment area 422 (e.g., unoccupied by the ejector plate 202), and thereby can facilitate loading of a support strap 104 onto the hook 414 and into the containment area 422. Once the support strap 104 is loaded onto the hook 414 (e.g., as shown in FIGS. 1A-1B), the clasp 204 can be manually released, where the weight 426 can bias the clasp 204 to the closed position to inhibit migration of the support strap 104 from the containment area 422.

Figure 6:
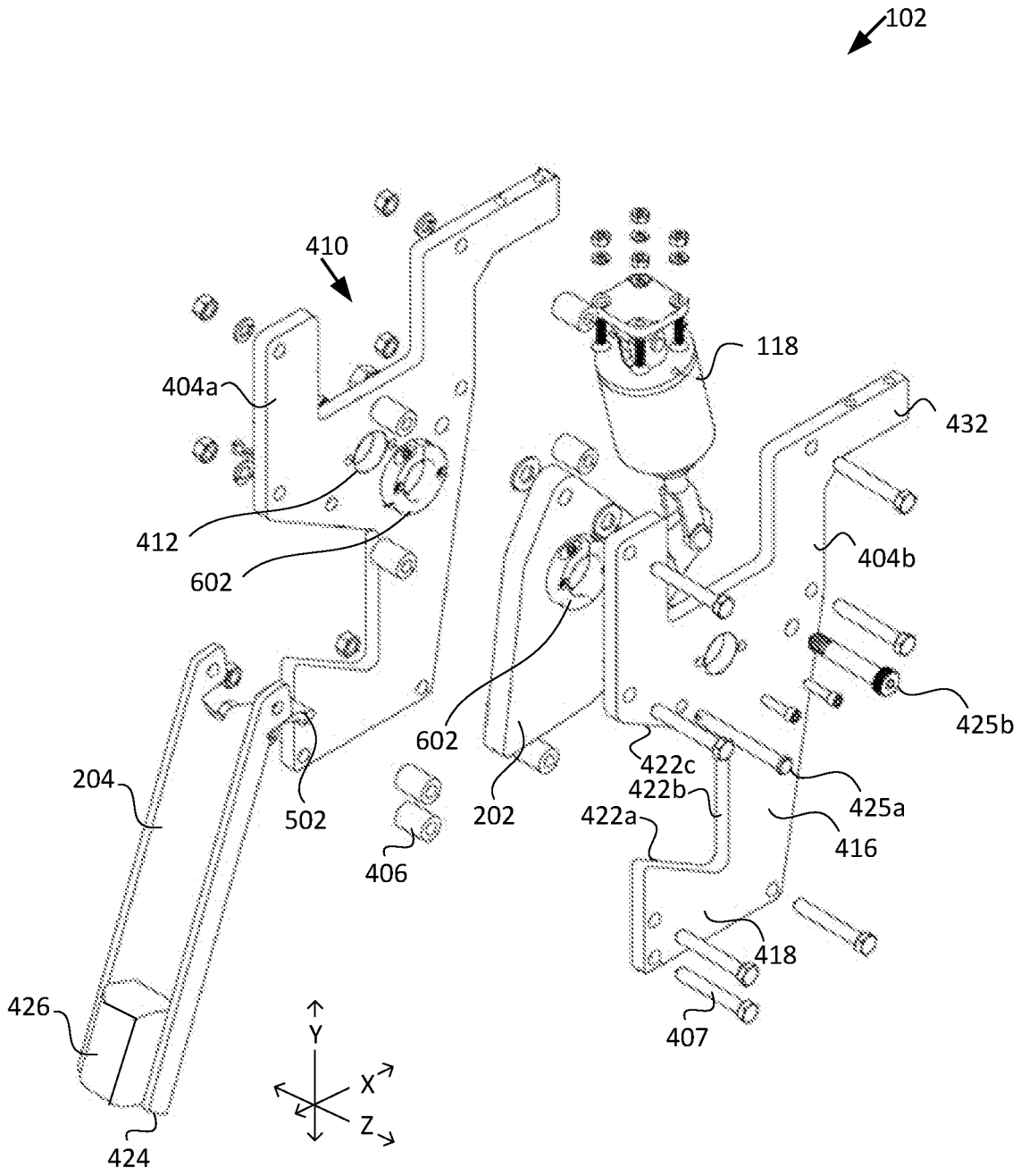
FIG. 6 illustrates a diagram of a non-limiting example exploded perspective of a bag hanger that can include a remotely actuated device (e.g., an ejection plate) in accordance with one or more embodiments described herein.

FIG. 6 depicts a non-limiting exploded view of an example bag hanger 102 in accordance with one or more embodiments described herein. For example, FIG. 6 depicts the various components of the bag hanger 102 disassembled and spaced apart to provide an illustration of the internal architecture of the bag hanger 102. While the various components are disassembled from each other, the components are depicted with an alignment that would facilitate assembly. In accordance with one or more embodiments described herein, each of the support plates 404 can be duplicates of each other; thus, for clarity of image, features labeled with reference numerals with regard to a single support plate 404 in FIG. 6. As shown in FIG. 6, the first support plate 404*a* and the second support plate 404*b* can be fastened together via one or more fastener 407, such as bolts that can extend through the support plates 404 along the lateral direction LA to engage one or more washers and/or nuts. As described herein, a plurality of spacers 406 can be positioned between the first support plate 404*a* and the second support plate 404*b* to define a gap into which a portion of the clasp 204 and/or ejector plate 202 can extend.

As shown in FIG. 6, one or more collars 602 can be positioned within the body 402 of the bag hanger 102. The one or more collars 602 can be aligned with the mounting passageway 412. For example, the one or more collars 602 can be configured to receive the support rod 112, same as the mounting passageway 412. In one or more embodiments, each support plate 404 can be fixed to a respective collar 602. Further, the diameter of each collar 602 can be adjustable, such that the collar 602 can be tightened around the support rod 112 when the bag hanger 102 is positioned at its desired location. Tightening the collar 602 can result in fixing the bag hanger 102 to the support rod 112 at the desired location (e.g., tightening the collar 602 can restrict movement of the bag hanger 102 along the support rod 112 in the lateral direction LA). In various embodiments, the support rod 112 can have a circular diameter (e.g., as shown) or a polygonal diameter (e.g., a square or hexagonal diameter). Likewise, the one or more collars 602 can have circular geometry or a polygonal geometry (e.g., a square or hexagonal geometry) to complement the support rod 112.

Figure 7:
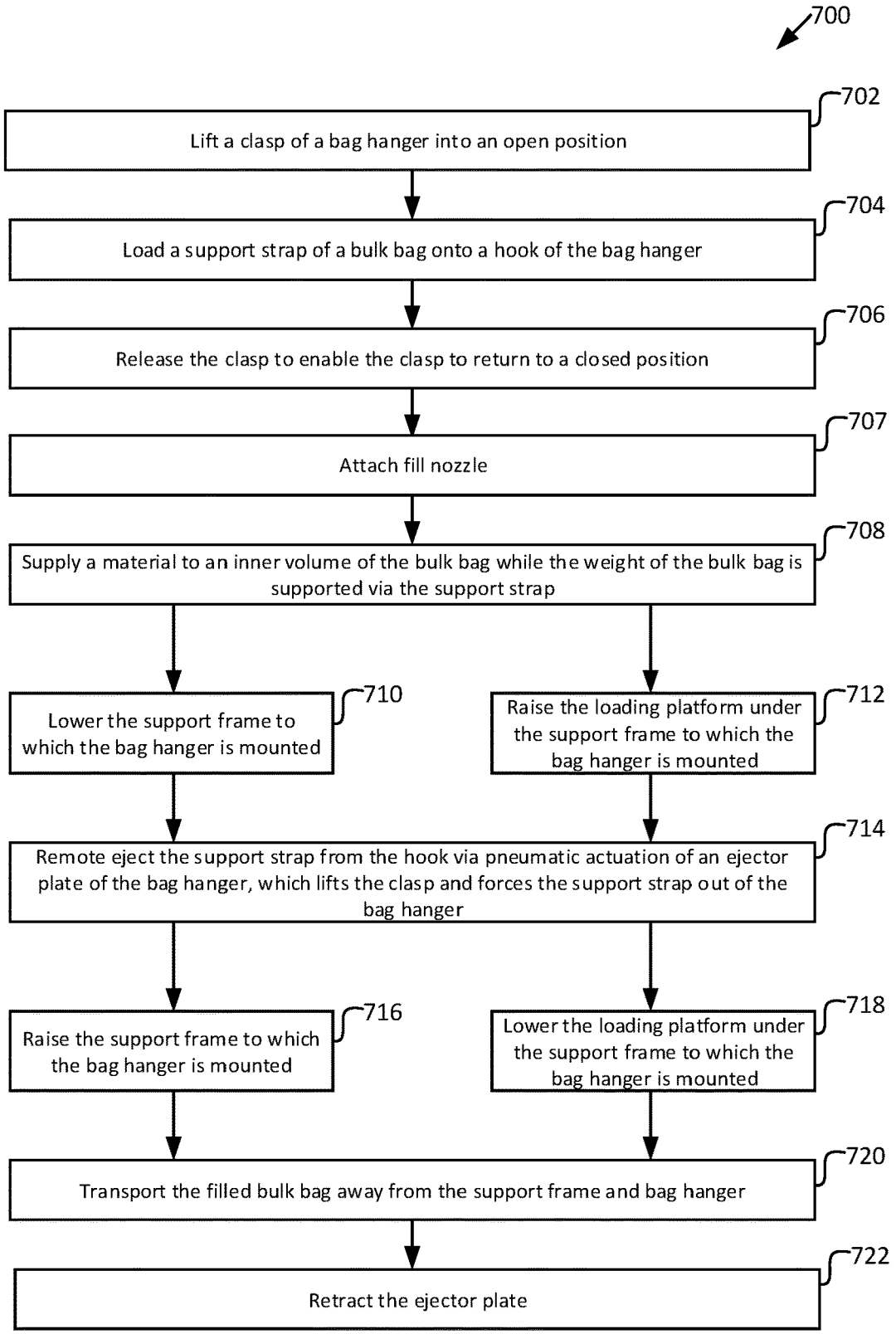
FIG. 7 illustrates a flow diagram of a non-limiting example filling operation that can be implemented using a bulk filler equipment assembly comprising one or more loaded bag hangers, where the bag hangers can include a remotely actuated device (e.g., an ejection plate) in accordance with one or more embodiments described herein.

FIG. 7 illustrates a flow diagram of a non-limiting example filling operation 700 that can be executed using the equipment assembly 100 and bag hangers 102 in accordance with one or more embodiments described herein.

At 702, the filling operation 700 can comprise lifting the clasp 204 of a bag hanger 102 to the open position. For example, the clasp 204 can be manually lifted to enable access to the hook 414 of the bag hanger 102. The clasp 204 operation at 702 can be repeated for each of the available bag hangers 102 of an equipment assembly 100.

At 704, the filling operation 700 can comprise loading a support strap 104 of a bulk bag 106 onto the exposed hook 414 of the bag hanger 102. For example, the support strap 104 can be positioned within a containment area 422 at least partially defined by, and supported by, a hook 414. Due to the integral nature of the hook 414 with the body 402 of the bag hanger 102, the support strap 104 can be loaded onto the hook 414 with a mitigated risk of inadvertent ejection. The loading operation at 704 can be repeated for each of the available bag hangers 102 of the equipment assembly 100.

At 706, the filling operation 700 can comprise releasing the clasp 204 to enable the clasp 204 to return to a closed position (e.g., as shown in FIGS. 1A-1B). For example, the clasp 204 can be biased (e.g., via a weight 426 and/or a spring) to the closed positioned. While in the closed position, at least a portion of the clasp 204 can define a side of the containment area 422 that inhibits migration of the support strap 104 from the hook 414. The clasp 204 operation at 706 can be repeated for each of the available bag hangers 102 of the equipment assembly 100. At 707, the filling operation 700 can comprise attaching a fill nozzle to the bulk bag to facilitate the supply of material.

At 708, the filling operation 700 can comprise supplying a material to an inner volume of the bulk bag 106. For example, the material can be supplied to the bulk bag 106 via the material inlet 126. As the bulk bag 106 is filled with the material, the increasing weight of the bulk bag 106 can be supported by the one or more bag hangers 102, and thereby by a support frame 108 to which the bag hangers 102 are mounted.

In one or more embodiments, the one or more bag hangers 102 can be mounted to a support frame 108 that is a part of a height adjustable apparatus (e.g., wherein the height of the support frame 108 can be lower or raised), and the filling operation 700 can proceed to 710. Alternatively, in one or more embodiments the one or more bag hangers 102 can be mounted to a support frame 108 positioned over a height adjustable loading platform (e.g., where the height of the loading platform can be lowered or raised), and the filling operation 700 can proceed to 712.

At 710, the filling operation 700 can comprise lowering the support frame 108 to which the bag hanger 102 is mounted. For example, the support frame 108, and thereby the bag hanger 102, can be lowered towards a loading platform (not shown) configured to support the weight of the filled bulk bag 106. The support frame 108 can be lowered until the weight of the filled bulk bag 106 is supported by the loading platform and relieved from the bag hangers 102.

At 712, the filling operation 700 can comprise raising the loading platform that is positioned under the support frame 108. For example, the loading platform can be raised toward the filled bulk bag 106 while the support frame 108, and thereby the bag hangers 102, remain in at a fixed height. The loading platform can be raised until the weight of the filled bulk bag 106 is supported by the loading platform and relieved from the bag hangers 102.

At 714, the filling operation 700 can comprise remote ejecting the support strap 104 from the hook 414 via actuation (e.g., pneumatic, hydraulic, or electric driven) of an ejector plate 202 of the bag hanger 102, which can lift the clasp 204 to the open position and force the support strap 104 out of the bag hanger 102. For example, the ejector plate 202 can be operably coupled to an actuator 118 which can extend to drive the ejector plate 202 into the containment area 422. As the ejector plate 202 is driven into the containment area 422, the ejector plate 202 can engage the positioning arm 428 of the clasp 204 and force the clasp into the open position (e.g., as shown in FIG. 5B). Further, as the ejector plate 202 is driven into the containment area 422, the ejector plate 202 can displace the support strap 104 from the hook 414 (e.g., as shown in FIGS. 2A-2B). While the ejector plate 202 displaces the support strap 104, the hook 414 can remain in a fixed position.

In one or more embodiments, the actuator 118 can be controlled remotely via a fluid control system 107 or an electric control system (e.g., via a wired or wireless connection). In some embodiments, each bag hanger 102 mounted to the support frame 108 can be operated by a single fluid control system 107 in unison. In other embodiments, a subset of the bag hangers 102 mounted to the support frame 108 can be operated by a first fluid control system 107 or first electric control system, while another subset of the bag hangers 102 can be operated by a second fluid control system 107 or second electric control system; thereby, the subsets of bag hangers 102 can be operated independent of each other.

Where the one or more bag hangers 102 are mounted to a support frame 108 that is a part of a height adjustable apparatus the filling operation 700 can proceed to 715. Alternatively, where the one or more bag hangers 102 are mounted to a support frame 108 positioned over a height adjustable loading platform, the filling operation 700 can proceed to 716.

At 716, the filling operation 700 can comprise raising the support frame 108 to which the bag hanger 102 is mounted. For example, the support frame 108 can be raised to a ready position to facilitate the loading of another bulk bag.

At 718, the filling operation 700 can comprise lowered the loading platform that is positioned under the support frame 108. For example, the loading platform can be lowered to a ready position to facilitate the loading of another bulk bag.

At 720, the filling operation 700 can comprise transporting the filled bulk bag away from the support frame 108 and/or the bag hanger 102. For example, the loading platform (e.g., a pallet) can be transported to another location for further processing and/or delivery.

At 722, the filling operation 700 can comprise retracting the ejector plate 202. For example, retraction of the ejector plate 202 can be also be controlled via the actuator 118 and the fluid control system 107. As the ejector plate 202 is retracted from the containment area 422, the clasp 204 can be biased to return to the closed position.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, as used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A bag hanger, comprising:

a plurality of support plates coupled together to form a body structure;

a hook that is integral with the body structure, wherein the hook at least partially defines a containment area and is configured to receive a bag strap; and an ejector plate, positioned between the plurality of support plates, for translating between a loading position out the containment area and an ejecting position within the containment area and coupled to an actuator for translating the ejector plate out of and within the containment area, wherein the actuator is coupled to the ejector plate and the body structure.

2. The bag hanger of claim 1, wherein the ejector plate is configured to translate between the loading position and the ejecting position while the hook remains in a fixed position, wherein the ejector plate is absent from the containment area while in the loading position, and wherein the ejector plate is positioned within the containment area while in the ejecting position.

3. The bag hanger of claim 2, wherein the actuator is a gas cylinder, a hydraulic cylinder, or an electric cylinder, wherein the ejector plate is configured to be in the loading position based on the actuator being in a retracted state, and wherein the ejector plate is configured to be in the ejecting positioned based on the actuator being in an extended state.

4. The bag hanger of claim 2, wherein the body structure includes a mounting channel defined by a groove in the plurality of support plates.

5. The bag hanger of claim 4, wherein the mounting channel and the hook are positioned at opposite ends of the body structure along a longitudinal direction of the bag hanger.

6. The bag hanger of claim 2, further comprising a clasp that is rotatably mounted to the body structure and configured to translate between a closed position and an open position, wherein the clasp is configured to abut the hook while in the closed position when the ejector plate is in the loading position, wherein the clasp is configured to be distanced from the hook while in the open position when the ejector plate is in the ejecting position.

7. The bag hanger of claim 6, wherein the clasp includes a positioning arm that extends toward the ejector plate, wherein the positioning arm extends from a surface of the clasp that faces the hook, and wherein the positioning arm extends between the plurality of support plates while the clasp is in the closed position.

8. The bag hanger of claim 6, wherein the clasp includes a positioning arm that extends toward the ejector plate, wherein the positioning arm is configured to abut the ejector plate while the ejector plate is in the ejecting position, and wherein the positioning arm supports the clasp in the open position while the ejector plate is in the ejecting position.

9. The bag hanger of claim 6, wherein the clasp includes a weight positioned at a distal end of the clasp, wherein the weight biases the clasp to the closed position.

10. A bulk bag filler equipment assembly, comprising:

a support frame comprising a support rail;

a bag hanger mounted to the support rail, wherein the bag hanger comprises:

a hook that is integral with a body of the bag hanger, wherein the hook at least partially defines a containment area and is configured to receive a bag strap, and an ejector plate at least partially positioned within the body, and wherein the ejector plate is configured to translate between a loading position out the containment area and an ejecting position area and an ejecting position within the containment area while the hook remains in a fixed position; and a fluid control system coupled to the bag hanger, wherein the fluid control system is configured to control operation of the ejector plate.

11. The bulk bag filler equipment assembly of claim 10, wherein the body of the bag hanger comprises a plurality of support plates coupled together.

12. The bulk bag filler equipment assembly of claim 10, wherein the bag hanger further comprises an actuator coupled to the body, the ejector plate, and the fluid control system, wherein the ejector plate is configured to be in the loading position based on the actuator being in a retracted state, and wherein the ejector plate is configured to be in the ejecting positioned based on the actuator being in an extended state.

13. The bulk bag filler equipment assembly of claim 10, wherein the bag hanger further comprises a clasp that is rotatably mounted to the body and configured to translate between a closed position and an open position, wherein the clasp is configured to abut the hook while in the closed position.

14. The bulk bag filler equipment assembly of claim 13, wherein the clasp includes a positioning arm that extends toward the ejector plate, wherein the positioning arm extends from a surface of the clasp that faces the hook, and wherein the positioning arm extends into the body while the clasp is in the closed position.

15. The bulk bag filler equipment assembly of claim 13, wherein the clasp includes a positioning arm that extends toward the ejector plate, wherein the positioning arm is configured to abut the ejector plate while the ejector plate is in the ejecting position, and wherein the positioning arm supports the clasp in the open position while the ejector plate is in the ejecting position.

16. A method for filling a bulk bag, the method comprising:

loading a support strap of the bulk bag onto a hook of a bag hanger, wherein the hook is integral with a body of the bag hanger, wherein the hook at least partially defines a containment area and is configured to receive a bag strap, and wherein the bag hanger comprises an ejector plate, for translating between a loading position out the containment area and an ejecting position within the containment area, and coupled to an actuator;

supplying a material to the bulk bag; and ejecting the support strap from the hook via a movement of the ejector plate that is driven by the actuator, wherein the ejector plate moves from the loading position to the ejecting position while the hook remains in a fixed position.

17. The method of claim 16, wherein moving the ejector plate from the loading position to the ejecting position engages a positioning arm of a clasp of the bag hanger and forces the clasp into an open position.

18. The method of claim 16, further comprising:

lowering a support frame toward the bulk bag subsequent the supplying the material and prior to the ejecting the support strap; or raising a loading platform toward the bulk bag subsequent the supplying the material and prior to the ejecting the support strap.

19. The method of claim 16, wherein the hook at least partially defines the containment area that is configured to receive the support strap, and wherein actuation of the ejector plate by the actuator displaces the support strap from the containment area by moving the ejector plate into the ejecting position.

20. The method of claim 19, further comprising:

retracting the ejector plate from the containment area by controlling the actuator, wherein the ejector plate is positioned within the containment area while the actuator is in an extended state, and wherein the ejector plate is absent from the containment area while the actuator is in a retracted state.

* * * * *